US007783068B2

(12) United States Patent
Klemenz et al.

(10) Patent No.: US 7,783,068 B2
(45) Date of Patent: Aug. 24, 2010

(54) HEARING DEVICE WITH A DAMPING ELEMENT

(75) Inventors: Harald Klemenz, Fürth (DE); Uwe Rass, Nürnberg (DE); Gerhard Röhrlein, Höchstadt (DE); Joseph Sauer, Strullendorf (DE); Markus Trautner, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1055 days.

(21) Appl. No.: 11/499,487

(22) Filed: Aug. 4, 2006

(65) Prior Publication Data

US 2007/0036381 A1 Feb. 15, 2007

(30) Foreign Application Priority Data

Aug. 4, 2005 (DE) ..... 10 2005 036 849

(51) Int. Cl.
*H04R 25/00* (2006.01)

(52) U.S. Cl. ..... 381/328; 381/330; 381/380; 381/381

(58) Field of Classification Search ..... 381/322, 381/327–328, 330, 380–381; 379/430
See application file for complete search history.

(56) References Cited

U.S. PATENT DOCUMENTS

| | | | | |
|---|---|---|---|---|
| 4,296,829 | A | 10/1981 | Pedersen | |
| 5,046,580 | A * | 9/1991 | Barton | 381/330 |
| 5,412,736 | A * | 5/1995 | Keliiliki | 381/330 |
| 5,606,621 | A | 2/1997 | Reiter et al. | |
| 6,275,596 | B1 | 8/2001 | Fetz et al. | |
| 6,735,319 | B1 | 5/2004 | Volanthen | |
| 6,766,030 | B1 | 7/2004 | Chojar | |

FOREIGN PATENT DOCUMENTS

| | | |
|---|---|---|
| DE | 31 41 921 | 5/1983 |
| DE | 89 05 756.2 | 8/1989 |
| DE | 298 01 567 U1 | 5/1998 |

* cited by examiner

*Primary Examiner*—Suhan Ni
(74) *Attorney, Agent, or Firm*—Schiff Hardin LLP

(57) ABSTRACT

A hearing device has an ear fitting piece, a housing part wearable behind the ear, and an earpiece tube connecting the ear fitting piece and the housing part. The transmission of mechanical vibrations between the ear fitting piece and the housing part via the earpiece tube is prevented by damping elements located in the region of the connection points between the ear fitting piece and the earpiece tube, or between the earpiece tube and the housing part. The damping elements damp mechanical vibrations in the transition region. A damping element that prevents the transmission of mechanical vibrations can also be present on or in the earpiece tube. The feedback tendency in the appertaining hearing device is thereby reduced.

14 Claims, 3 Drawing Sheets

HEARING DEVICE WITH A DAMPING ELEMENT

BACKGROUND OF THE INVENTION

1. Field of the Invention

The present invention concerns a hearing device of the type having at least one housing part wearable behind the ear, an ear fitting piece wearable in the ear, an earpiece tube connecting the housing part with the ear fitting piece, a microphone for acquisition of an acoustic input signal and emission of an electrical input signal, a signal processing and amplifier unit for processing and amplification of the electrical input signal and for emission of an electrical output signal, and an earpiece arranged in the ear fitting piece for transducing of the electrical input signal into an acoustic output signal. The invention also concerns an earpiece tube for such a hearing device.

2. Description of the Prior Art

In a behind-the-ear hearing device with a housing part that can be worn behind the ear and an ear fitting piece (otoplastic) wearable in the ear, the sound is transported from the hearing device into the ear of the patient through an earpiece tube. For a behind-the-ear hearing device equipped with an (external) earpiece arranged in the ear fitting piece, the electrical conductor with which the earpiece is coupled to the hearing device runs through the earpiece tube.

Since the hearing device, including earpiece tube and possibly the earpiece or otoplastic, abuts the body of the hearing device user, structure-borne sound can be transferred from the hearing device user to the hearing device. The coupling of the structure-borne sound ensues either directly from the body of the hearing device user to the hearing device itself, or via the earpiece or the earpiece tube to the hearing device, caused by vibrations of the earpiece or other events. The structure-borne sound can conversely also propagate from the hearing device via the earpiece tube and the earpiece or, respectively, the otoplastic to the ear. In each case the injected structure-borne sound adulterates the usable signal.

Hearing devices wearable behind the ear with an earpiece in the ear fitting piece, known as RIC (receiver in canal) devices, are prone to feedback in spite of the relatively large separation between the earpiece and the microphone. This results from the (often relatively rigid) connection of the hearing device housing with the ear fitting piece through which the vibrations of the earpiece are mechanically coupled back via the earpiece tube.

Moreover, mechanical feedbacks also increasingly occur in behind-the-ear hearing devices with an earpiece tube for sound conduction between the hearing device housing and the ear fitting piece, in which the earpiece tube also performs the function of a carrier that holds the hearing aid device behind the ear. Pre-formed earpiece tubes adapted to the anatomy of the ear are conventionally used for this purpose and must exhibit a specific rigidity for this purpose, and thus transfer mechanical vibrations (structure-borne sound) relatively well.

To avoid feedback it has previously been possible to reduce the effect of the structure-borne sound to the actual hearing device. For this purpose, the wall thickness of the housing of the hearing device is made as thick as possible in order to achieve an attenuating effect. Moreover, all internal mounting parts are designed such that they damp or filter out natural oscillations and structure-borne sound. Known measures for suppression of feedback in particular involve mounting or supporting the earpiece or the microphone in a vibration-damping manner.

By a reduced amplification or bandwidth, the feedback can be damped to a sufficient degree so that an electronic feedback compensator can prevent feedback whistling in the hearing device. More substantial, hearing losses, however, can then no longer be fully compensated.

A hearing device wearable behind the ear with an ear fitting piece that can be inserted into the auditory canal is known from DE 298 01 567 U1, in which the housing part wearable behind the ear and the ear fitting piece are connected with one another with a flexible carrying strap such that they can be detached. Together with jack bushing (receptacles) at the ear fitting piece and the housing part, jacks form detachable plug connectors for electrical and mechanical connection.

U.S. Pat. No. 6,766,030 discloses a hearing device wearable in the ear is known in which the earpiece is supported in a damping manner relative the housing of the hearing device such that mechanical vibrations transferred from the earpiece to the housing are attenuated.

A hearing device in which the earpiece emits neither structure-borne sound nor airborne sound to the microphone of the hearing device is known from DE 31 41 921 A1. For this purpose at least the housing of the earpiece is surrounded by a layer of foamed plastic with an air-tight outer skin.

Moreover, published European Application EP 1 484 943 A2 discloses a behind-the-ear hearing device that exhibits a one-part tubular shape as an external housing part. In the external housing part a speaker housing is held in rubber-elastic supports such that it can oscillate (vibrate) freely.

A hearing aid system in which the frequency response of the earpiece is influenced by the earpiece tube is also known from U.S. Pat. No. 6,275,596. For example, the tube tip can be provided with an acoustic damper in order to damp peaks in the frequency response of the earpiece.

SUMMARY OF THE INVENTION

An object of the present invention is to avoid feedback in an hearing device of the type described above that can be worn behind the ear with an ear fitting piece wearable in the ear.

The above object is achieved in accordance with the present invention by a hearing device having a housing part that is wearable behind the ear of a user, an ear fitting piece wearable in the ear of the user, an earpiece tube connecting the housing part with the ear fitting piece, a microphone that acquires an acoustic input signal and emits an electrical input signal corresponding thereto, a signal processing and amplifier unit that processes and amplifies the electrical input signal to produce therefrom, and emit, an electrical output signal, an earpiece that transduces the electrical output signal into an acoustic output signal, and at least one damping element that damps mechanical vibrations transferred between the ear fitting piece and the housing part via the earpiece tube.

The use of a damped earpiece tube causes to the extent possible, no signal adulteration of the sound that is transferred from the hearing device into the ear. The transfer of mechanical vibrations from the ear fitting piece via the earpiece tube to the housing part is also largely suppressed. In comparison to a hearing device without these vibration-damping measures, feedbacks occur significantly less frequently. The invention is particularly advantageous when the earpiece tube between the ear fitting piece and the housing part is fashioned in one piece and relatively rigid and also serves for mounting and fixing the hearing device on the ear of a user.

Furthermore, the invention can be used to particular advantage with an arrangement known as a "closed supply" is produced via the hearing device. The auditory canal volume enclosed by the ear fitting piece is thereby largely divided in an air-tight and sound-tight manner from the external environment of the ear, such that acoustic feedbacks between the earpiece and the microphone merely play a subordinate role. Mechanical feedbacks carry a much stronger weight in such an arrangement.

A number of possibilities exist for the arrangement of damping elements that limit the sound transfer from the ear fitting piece to the housing part. At least one damping element can be arranged on or in the earpiece tube. For this purpose the sound damping element preferably is a wire mesh. If the wire mesh is inserted in the manufacture of the tube, specific frequencies can be damped in a targeted manner. Depending on the type of the mesh, a broadband damping can also ensue. Signals can also be transferred via the wire mesh without the vibrations themselves being transferred.

Moreover, the sound damping element can be formed of foamed material, at least in part. Such foamed material reduces the rigidity of the earpiece tube both in the longitudinal direction and in the transversal direction, such that both longitudinal waves and transversal waves of the earpiece tube are attenuated.

The sound damping element can also be fashioned accordion-like in the longitudinal direction of the earpiece tube. Shear forces along the earpiece tube (and thus longitudinal waves) are thus absorbed.

Furthermore, the sound damping element can be an S-shaped tube piece. Shear forces along the earpiece tube also are reduced.

The sound damping elements described above can be combined in a suitable manner such that the damping effect can be correspondingly increased.

As noted above the earpiece tube can be used in connection with one hearing device. The usage of an inventive earpiece tube for other hearing devices (such as headsets, headphones and the like) is likewise beneficial.

The earpiece tube preferably is connected in a detachable manner both at the ear fitting piece and at the housing part. This enables a simple exchange, such as in the case of repair. Both a mechanical connection and an electrical connection between the earpiece tube and the ear fitting piece or the housing part can ensue in a simple manner by a plug connection. The ends of the earpiece tube can be fashioned as plugs or as jacks. According to the invention, a vibration-damping mounting of the plug or of the jack ensues at the respective ends of the earpiece tube. It is also possible to introduce a damping element in the region of the earpiece tube between the two ends. Apart from being mounted on the earpiece tube, damping elements can also be mounted on the ear fitting piece or the housing part. For a detachable connection with the earpiece tube, the ear fitting piece or, the housing part has a plug or a jack. According to the invention these are also advantageously mounted in a vibration-damping manner relative to the ear fitting piece or the housing part.

The vibrations transferred from the ear fitting piece to the housing part via the earpiece tube are already noticeably attenuated when vibration-damping measures are taken only at one point of the appertaining hearing device, for example in the region of a jack at one end of the housing part. A further reduction of the vibrations emanating from the ear fitting piece can be achieved by corresponding damping measures being taken at multiple points, for example both in the region of a jack at the housing part and in the region of a jack at the ear fitting piece, or both in the region of a jack and in the region of a plug that can be connected therewith.

Naturally, vibration-damping elements according to the invention can also be present in the transfer region between the earpiece tube and the housing part or between the earpiece tube and the ear fitting piece with a fixed (meaning not detachable) connection between the components.

DESCRIPTION OF THE PREFERRED EMBODIMENTS

Figure 1:
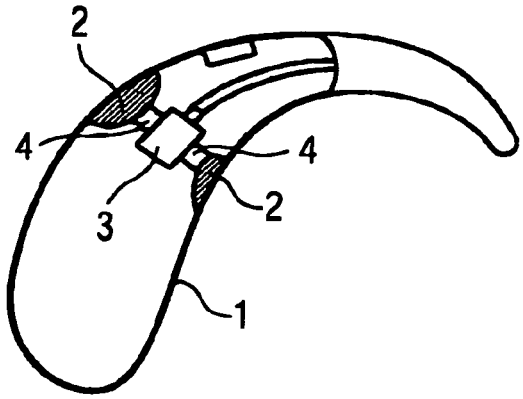
FIG 1 (Prior art)
FIG. 1 shows a behind-the-ear hearing device according to the prior art.

For better understanding of the invention, a known damping system is first briefly explained using FIG. 1. A housing 1 of a behind-the-ear hearing device possesses structures 2 that are internally injection-molded and serve for attachment of an earpiece. One or more damping elements 4 are accommodated between the earpiece 3 and the structure 2 or the hearing device housing 1 so that the earpiece 3 is not rigidly connected with these structures 2. This in large part prevents structure-borne sound from arriving unattenuated from the earpiece 3 to the installed microphone 5 via the hearing device housing 1. Feedbacks are thus for the most part prevented in this manner in a hearing device with an integrated earpiece 3.

Figure 2:
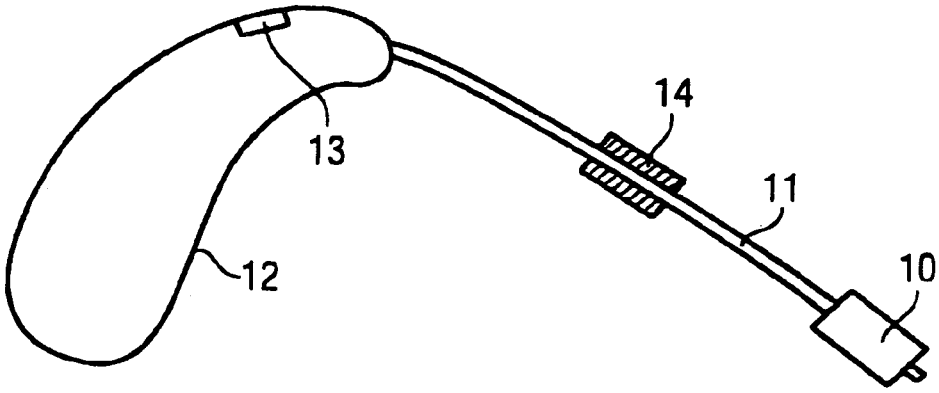
FIG. 2 shows a behind-the-ear hearing device with an external earpiece and an earpiece tube according to a first embodiment of the present invention.

In the case of a hearing device with external earpiece 10 according to FIG. 2, vibrations of the earpiece 10 are transferred via an earpiece tube 11 to the hearing device housing 12. The microphone 13 installed in the hearing device housing 12 acquires these transferred vibrations as structure-borne sound, such that under the circumstances they lead to interfering feedback. In order to prevent this, according to the invention a damping element 14 is attached in and/or on the earpiece tube 11. This damping element 14 causes structure-borne sound in a transmission path from the earpiece 10 to the microphone 13 to be additionally attenuated.

The damping element 14 embodies, for example, an additional mass that reduces the vibrations of the earpiece tube 11. Corresponding to a different variant of the damped earpiece tube 11, the damping element 14 is integrated into the earpiece tube 11 as a foamed tube segment. This foamed segment then barely transfers vibrations any more from one part of the earpiece tube 11 to the other part.

Figure 3:
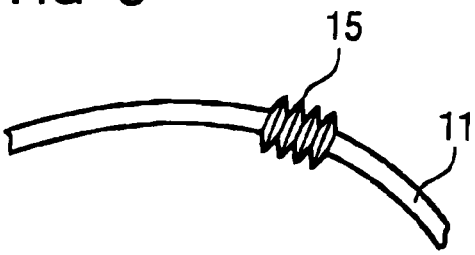
FIG. 3 shows an earpiece tube according to a second embodiment.

A second embodiment of the inventive earpiece tube is shown in FIG. 3. In this embodiment, the earpiece tube is fashioned like an accordion 15 in a middle segment. Longitudinal waves (but also transversal waves) are barely transferred across this accordion-like segment.

Figure 4:
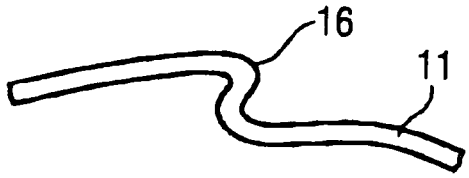
FIG. 4 shows an earpiece tube according to a third embodiment.

A very simple variant of an inventive damping element is for a middle segment 16 to be designed S-shaped, as shown in FIG. 4. This S-shaped segment 16 also damps shear forces in the earpiece tube 11.

Figure 5:
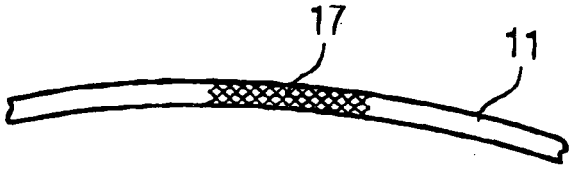
FIG. 5 shows an earpiece tube according to a fourth embodiment.

In the fourth exemplary embodiment according to FIG. 5, inside the earpiece tube a wire mesh 17 is inserted into a region of the earpiece tube 11 during manufacturing thereof. Depending on the hardness and structure of the wire mesh 17 and also the plastic/rubber used, the inventive earpiece tube 11 will filter and damp the desired frequencies.

In the hearing device with external earpiece 10 explained in connection with FIG. 2, the damped earpiece tube 11 in which the electrical lines to the earpiece 10 run reduces the acoustic feedback from the earpiece 10 to the microphone 13. However, for a hearing device with integrated earpiece 3 corresponding to FIG. 1 the need also exists to damp the structure-borne sound transmitted via the earpiece tube. In such hearing devices this structure-borne sound leads to signal distortions when the usable sound that is conducted from the earpiece 3 into the ear via the earpiece tube is adulterated by noise portions that likewise arrive in the ear via the earpiece tube wall. Here the damped earpiece tube can likewise be beneficially used corresponding to the present invention.

The embodiments shown in detail above can be used individually or in combination. The desired degree of attenuation can thus be achieved for one or more frequencies.

Figure 6:
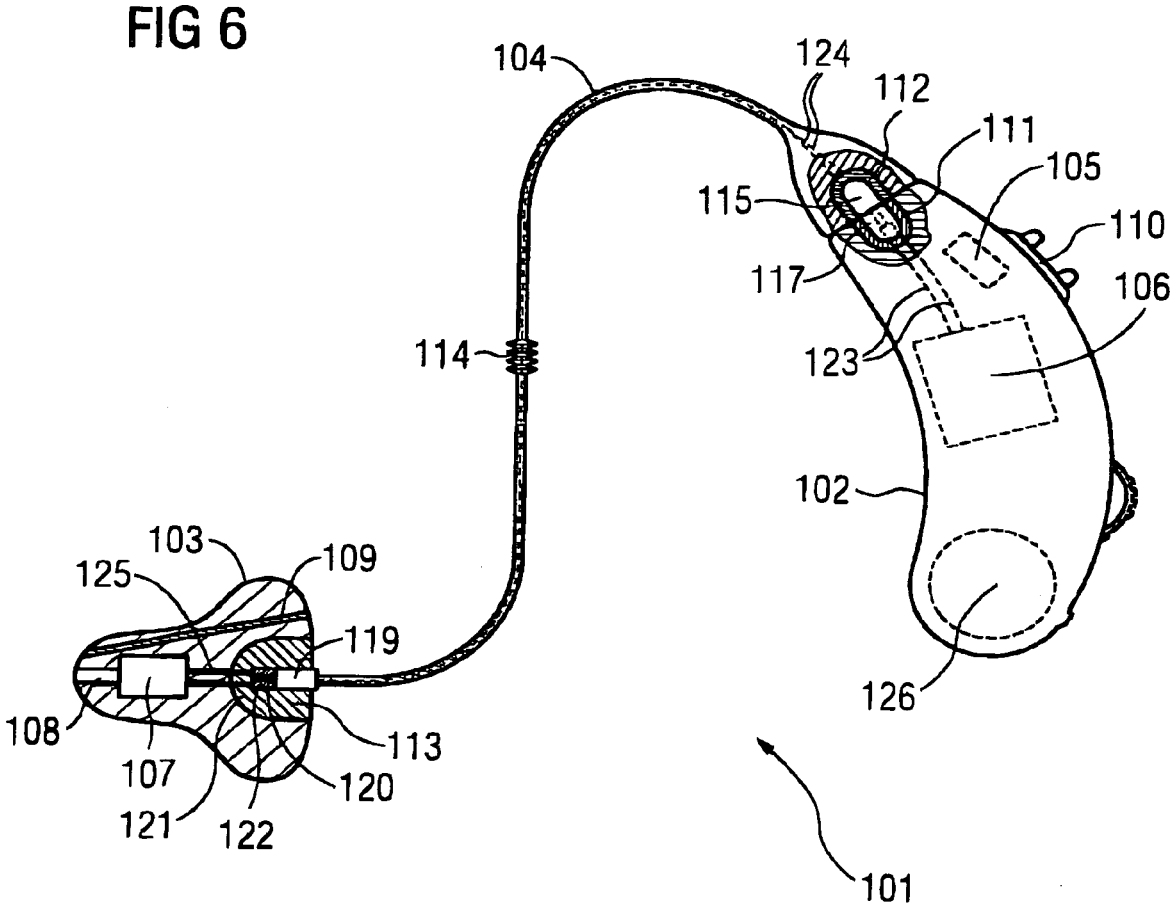
FIG. 6 shows an hearing device with a housing part wearable behind the ear, an ear fitting piece wearable in the ear and an earpiece tube connecting the housing part and the ear fitting piece.

FIG. 6 shows a behind-the-ear hearing device 101 that has a housing part 102 wearable behind the ear, an ear fitting piece 103 wearable in the ear, and an earpiece tube 104 connecting the housing part 102 with the ear fitting piece 103. A microphone 105 acquires an acoustic input signal and transduces the acoustic input signal into an electrical input signal. The electrical input signal emitted by the microphone 105 is supplied to a signal processing and amplifier unit 106 for compensation of the hearing loss of a user. The electrical output signal arising from this is supplied via electrical lines 123, 124 and 125 to an earpiece 107 that transduces the electrical output signal into an acoustic output signal and emits this into the auditory canal of the user via a sound canal 108. A ventilation channel (vent) 109 serves for ventilation of the auditory canal volume enclosed by the ear fitting piece 103. Furthermore, the hearing device 101 has an operating element 110 operable by the user a well as a voltage source in the form of a battery 126 for voltage supply of the electronic components of the hearing device 101.

In order to ensure a good purchase (retention) of the hearing device 101 on the ear, the earpiece tube 104 is produced from a relatively rigid plastic material. The earpiece tube 104 can, for example, be adapted under heat exposure to the individual anatomical conditions of the user. Following such an adaptation it can be elastically deformed. The earpiece tube 104 encloses the electrical lines 124 for electrical connection of the earpiece 107 with the signal processing and amplifier unit 106.

So that the earpiece tube 104 adapted to the anatomical conditions retains its shape, a specific rigidity is required. This has the disadvantage that mechanical vibrations transferred on the ear fitting piece 103 are relayed to the housing part 102 via the earpiece tube 104, and these mechanical vibrations can also arrive at the microphone 105. Unwanted mechanical feedback thereby arises.

In the hearing device 101 according to the exemplary embodiment, the earpiece tube 104 is connected in a detachable manner both with the ear fitting piece 103 and with the housing part 102. The detachable electrical and mechanical connection ensues via contact pins 116 and 120 that are plugged into respective jacks 118 and 122 in the housing part 102 or the ear fitting piece 103. For vibration damping according to the invention, the plug part 115 is mounted such that it floats in the damping element 112 formed of vibration-damping material. The jack part 117 is likewise floats with the jack 118 in a corresponding damping element 111 at the end of the housing part 102. By means of the shown arrangement the transfer of mechanical vibrations from the earpiece tube 104 to the housing part 102 is suppressed to the greatest possible extent. The second end of the earpiece tube 104 is also decoupled from the ear fitting piece 103 in terms of vibrations in a corresponding manner. In contrast to the connection with the housing part 102, however, in the opposite end of the earpiece tube 104 the plug part 119 with the plug 120 is attached directly (meaning without vibration-suppressing measures) to the earpiece tube 104. However, in the ear fitting piece 103 the jack part 121 with the jack 122 is mounted so as toe float (analogous to the housing part 102) in the damping element 113 made from vibration-damping material. The transfer of mechanical vibrations from the ear fitting piece to the earpiece tube 104 is hereby suppressed.

A damping element 114 is present in the earpiece tube 104 as a further vibration-damping measure. This sub-divides the earpiece tube 104 into two sub-segments that are connected with one another in a vibration-damping manner.

Overall an operation- and maintenance-friendly hearing device 101 with the three components ear fitting piece 103, earpiece tube 104 and housing part 102 that are connected with one another in a detachable manner is achieved via the shown measures, in which hearing device 101 the transmission of mechanical vibrations from the ear fitting piece 103 to the housing part 102 is suppressed to the greatest possible extent.

Figure 7:
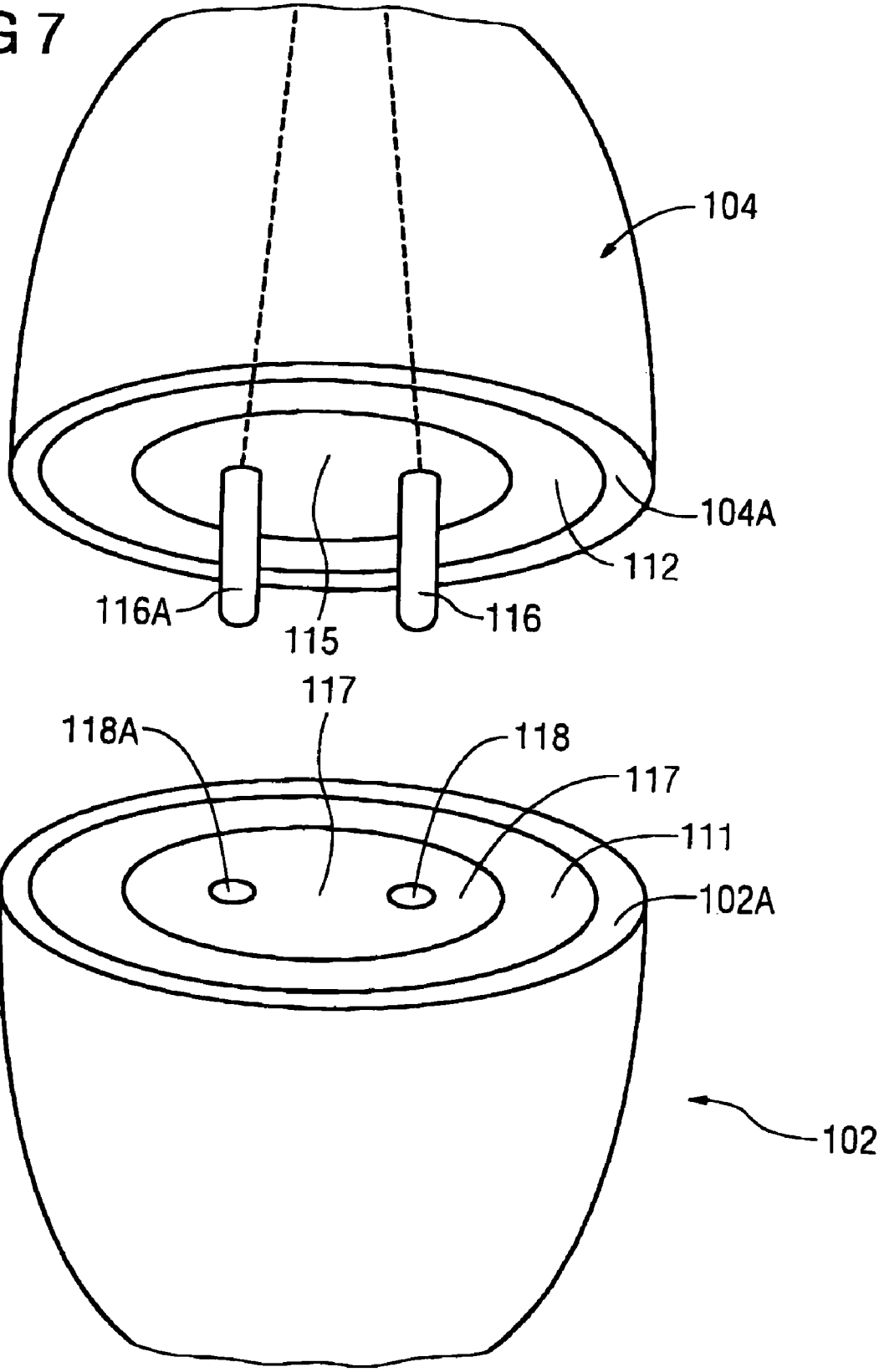
FIG. 7 is a detail of a detachable connection between the earpiece tube and the housing part.

FIG. 7 shows a detailed view of the plug connection between the earpiece tube 104 and the housing part 102. The plug part 115 with both contact pins 116 and 116A is located at the end of the earpiece tube 104. The plug part 115 is separated from plastic material of the earpiece tube 104 by the damping unit 112 made from vibration-damping material. In particular the plug part 115 is mounted so as to be float in the damping element 112. Thus no direct connection exists between the plug part 115 and the plastic material of the outer jacket 104A of the jack part 104. The jack part 117 with both jacks 118 and 118A is also separated from the housing of the housing part 102 via the damping element 111 and in particular is mounted so as to be floating in the damping element 111. Thus no direct connection between the outer jacket 104A of the jack part 104 and the housing 102A of the housing part 102 arises upon establishment of the electrical and mechanical connection between the earpiece tube 104 and the housing part 102 by insertion of the pins 116 and 116A into the jacks 118 or and 118A. The transmission of mechanical vibrations from the earpiece tube 104 to the housing part 102 thus is largely suppressed by the damping elements 111 and 112.

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing device comprising:

a housing part adapted to be worn behind an ear of a person;

an ear fitting piece adapted to be worn in the ear of the person;

an earpiece tube connecting the housing part with the ear fitting piece;

a microphone contained in the housing part that acquires an acoustic input signal and emits an electrical input signal corresponding thereto;

a signal processing and amplifier unit in the housing part, supplied with said electrical input signal, that processes and amplifies said electrical input signal to produce and emit an electrical output signal;

an earpiece contained in said ear fitting piece, supplied with said electrical output signal, that transduces said electrical output signal into an acoustic output signal; and at least one damping element that damps mechanical vibrations transferred between said ear fitting piece and said housing part via said earpiece tube.

2. A hearing device as claimed in claim 1 wherein said at least one damping element is located at a position to damp mechanical vibrations emanating from said ear fitting piece and transferred to said housing part via said earpiece tube.

3. A hearing device as claimed in claim 1 wherein said damping element is located in or on said housing part.

4. A hearing device as claimed in claim 1 wherein said damping element is located in or on said ear fitting piece.

5. A hearing device as claimed in claim 1 wherein said damping element is located in or on said earpiece tube.

6. A hearing device as claimed in claim 5 wherein said earpiece tube has a longitudinal extent proceeding between said ear fitting piece and said housing part, and wherein said damping element comprises an accordion-like element disposed along said longitudinal extent of said earpiece tube.

7. A hearing device as claimed in claim 5 wherein said earpiece tube has a longitudinal extent proceeding between said ear fitting piece and said housing part, and wherein said damping element comprises an S-shaped bend along said longitudinal extent of said tube piece.

8. A hearing device as claimed in claim 5 wherein said tube piece has a longitudinal extent proceeding between said ear fitting piece and said housing part, and wherein said damping element comprises a wire mesh embodied in said tube piece along said longitudinal extent thereof.

9. A hearing device as claimed in claim 5 wherein said damping element is at least partially comprised of foamed material.

10. A hearing device as claimed in claim 1 wherein said earpiece tube has opposite ends respectively connected with said ear fitting piece and said housing part at respective connections, and wherein at least one of said connections is a detachable connection.

11. A hearing device as claimed in claim 10 wherein said detachable connection comprises a jack and a plug, with said jack being removably fittable into said plug.

12. A hearing device as claimed in claim 11 wherein said damping element comprises damping material surrounding said jack, with said jack floating in said damping material.

13. A hearing device as claimed in claim 11 wherein said damping element comprises damping material surrounding said jack, with said plug floating in said damping material.

14. A heading device as claimed in claim 1 wherein said ear fitting piece forms a closed supply with respect to the ear of the user.

* * * * *